US007029102B2

(12) United States Patent
Bybee et al.

(10) Patent No.: US 7,029,102 B2
(45) Date of Patent: Apr. 18, 2006

(54) INK DELIVERY REGULATION APPARATUS AND METHOD OF USE

(75) Inventors: Cary R. Bybee, Lebanon, OR (US); Anthony D. Studer, Albany, OR (US); Kevin D. Almen, Albany, OR (US); David J. Benson, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 163 days.

(21) Appl. No.: 10/665,053

(22) Filed: Sep. 16, 2003

(65) Prior Publication Data

US 2005/0057619 A1 Mar. 17, 2005

(51) Int. Cl.
*B41J 2/175* (2006.01)

(52) U.S. Cl. ..... 347/85; 347/86

(58) Field of Classification Search ..... 347/85–87
See application file for complete search history.

(56) References Cited

U.S. PATENT DOCUMENTS 5,153,612 A * 10/1992 Dunn et al. ..... 347/87
5,473,354 A 12/1995 Arquilevich et al.
5,734,401 A * 3/1998 Clark et al. ..... 347/86
5,745,137 A * 4/1998 Scheffelin et al. ..... 347/85
6,561,635 B1 5/2003 Wen

* cited by examiner

*Primary Examiner*—Shih-Wen Hsieh

(57) ABSTRACT

An ink delivery regulation apparatus includes a support configured to be positioned within an ink chamber and a resilient deflection member coupled to the support. The resilient deflection member is configured to resiliently deflect from a generally concave shape to a generally convex shape in response to a change in said negative pressure.

43 Claims, 5 Drawing Sheets

INK DELIVERY REGULATION APPARATUS AND METHOD OF USE

BACKGROUND

A typical thermal inkjet has an array of precisely formed nozzles attached to a print head substrate corresponding to an array of firing chambers that receive liquid ink from a reservoir. Each firing chamber may include a thin-film resistor or firing resistor located opposite the nozzle to allow for the presence of ink between the firing resistor and the nozzle. Electric pulses may then be applied to heat the firing resistors to cause a small portion of the ink near the firing resistor to vaporize. The pressure created by this vaporization drives a small amount of ink through the nozzle. The nozzles may be arranged in a matrix array. Properly sequencing the operation of each nozzle in the array causes characters and/or images to form as the print head is moved with respect to a print medium, such as a piece of paper.

Efforts have been made to reduce the cost and size of ink-jet printers and to reduce the cost per printed page. Some of these efforts have focused on developing printers having small, moving print heads that are connected to larger stationary ink reservoirs by flexible ink tubes. This configuration is commonly referred to as "off-axis" printing.

The development of off-axis printing has created the need to precisely control the pressure of the ink at a variety of locations including the ink reservoir and the print head. Print cartridges may have an internal pressure regulator for regulating the flow of ink from an external source into an ink chamber within the print cartridge. Print cartridges with an internal pressure regulator often incorporate a diaphragm in the form of a bag. The inside of the bag is open to the atmosphere. The expansion and contraction of the bag controls the flow of ink into the print cartridge to maintain a relatively constant back pressure at the print head.

However, when too much air has accumulated in the body and/or manifold of the print cartridge, the regulator may no longer have the capacity to maintain negative pressure. At that point, air in the print head may render nonfunctional any pressure regulator internal to, or leading to, the print cartridge. As a result, the desired back pressure may be lost (for example, due to variation in the temperature or pressure of the ambient environment), and ink may drool out of the print head. A drooling print head may cause permanent damage to the printer and will likely be unable to print with an acceptable print quality.

Designs utilizing a separate pressure regulator to address these issues may be relatively complicated. In addition, the use of a separate pressure regulator may limit the operating efficiency of the printing device. Accordingly, recent efforts have been directed to providing a less complicated ink supply system that is able to reliably provide back pressure. Some designs utilize foam placed in the ink supply. As the ink supply is drained, the volume of the ink supply tends to decrease. The foam provides small capillary volumes which retain ink; the capillary attraction of the ink to the capillary volumes creates a back pressure. Similarly, other designs utilize a spring placed in an ink bag. However, with these designs, a significant amount of the ink in the supply may be stranded and therefore wasted. Such waste may require more frequent ink re-supply, thereby increasing the operating cost of the system.

SUMMARY

An ink delivery regulation apparatus includes a support configured to be positioned within an ink chamber and a resilient deflection member coupled to the support. The resilient deflection member is configured to resiliently deflect from a generally concave shape to a generally convex shape in response to a change in said negative pressure.

BRIEF DESCRIPTION OF THE DRAWINGS

The accompanying drawings illustrate various embodiments of the present apparatus and method and are a part of the specification. The illustrated embodiments are merely examples of the present apparatus and method and do not limit the scope of the disclosure.

Throughout the drawings, identical reference numbers designate similar, but not necessarily identical, elements.

DETAILED DESCRIPTION

An ink delivery apparatus and method of use are described herein. As used herein and in the appended claims, the term "ink" shall refer broadly to any ink, toner, colorant or other liquid marking fluid ejected by a print head. According to one exemplary embodiment described below, an ink delivery regulation apparatus includes a support positioned within an ink chamber and a resilient deflection member coupled to the support. The resilient deflection member is configured to resiliently deflect from a generally concave shape to a generally convex shape in response to a change in said negative pressure.

In the following description, for purposes of explanation, numerous specific details are set forth in order to provide a thorough understanding of the present apparatus and method. It will be apparent, however, to one skilled in the art that the present apparatus and method may be practiced without these specific details. Reference in the specification to "one embodiment" or "an embodiment" means that a particular feature, structure, or characteristic described in connection with the embodiment is included in at least one embodiment. The appearance of the phrase "in one embodiment" in various places in the specification are not necessarily all referring to the same embodiment.

Exemplary Structure

Figure 1:
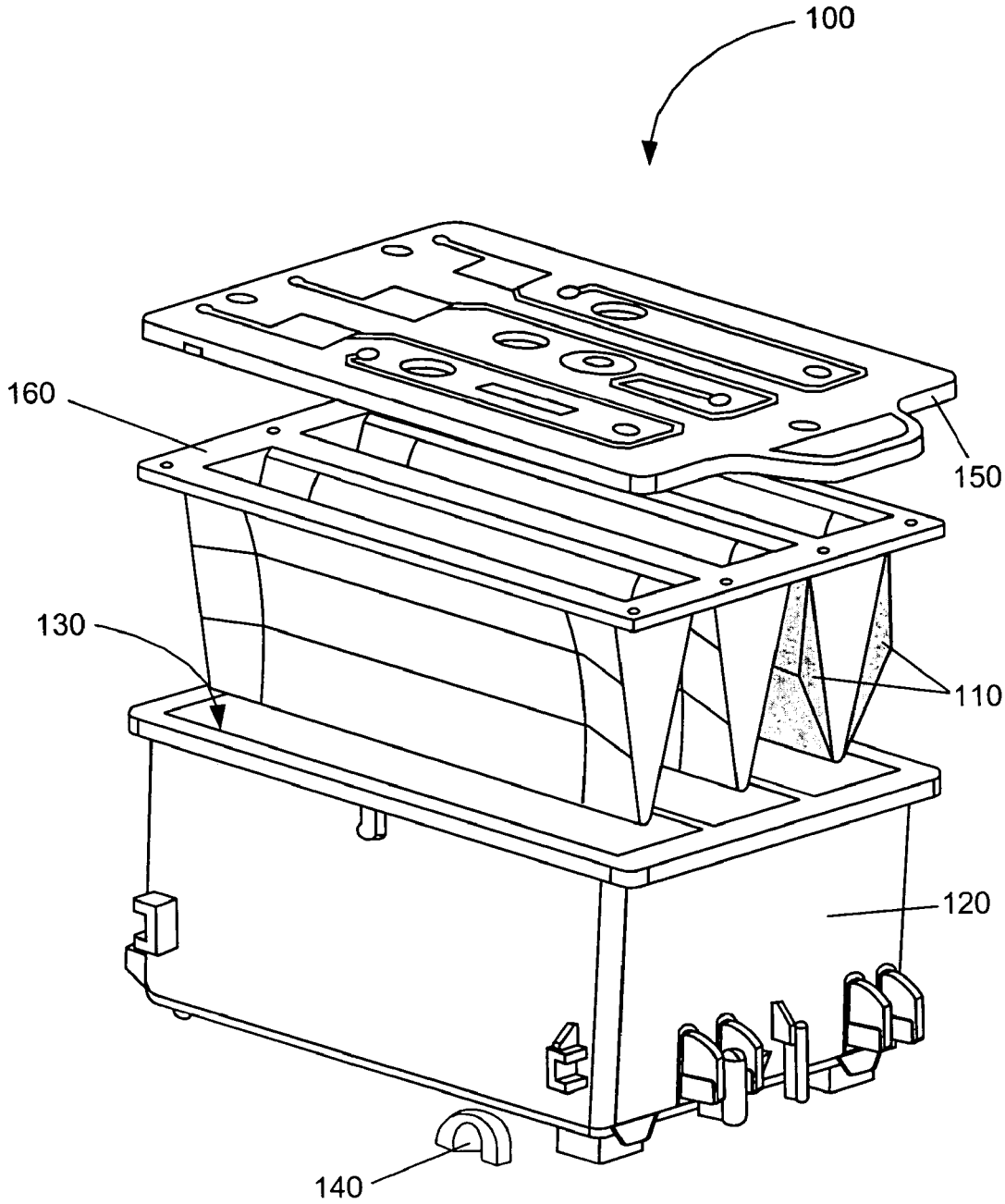
FIG. 1 illustrates an exploded view of an ink delivery apparatus according to one exemplary embodiment.

FIG. 1 illustrates an exploded view of an ink delivery assembly (100) that generally includes ink delivery regulation members (110), a fitment (120) in which are defined a plurality of ink chambers (130); bubble generator (140) and cover (150). In the illustrated assembly, two ink delivery regulation members (110) are associated with each of the ink chambers (130). Further, a pressure regulation assembly may be integrally formed by grouping a plurality of ink delivery regulation members (110). Accordingly, a pressure regulation assembly may be integrally placed within the ink chambers (130). The ink delivery regulation members (110) are secured to the ink chambers (130) by cover (150). The bubble generator (140) may be disposed in the fitment (120) and be in communication with each of the ink chambers. In addition, the cover may be configured such that a portion (160) of the ink delivery regulation members (110) may be open to atmospheric pressure. Operation of the ink delivery assembly (100) will be discussed in detail below.

Figure 2A:
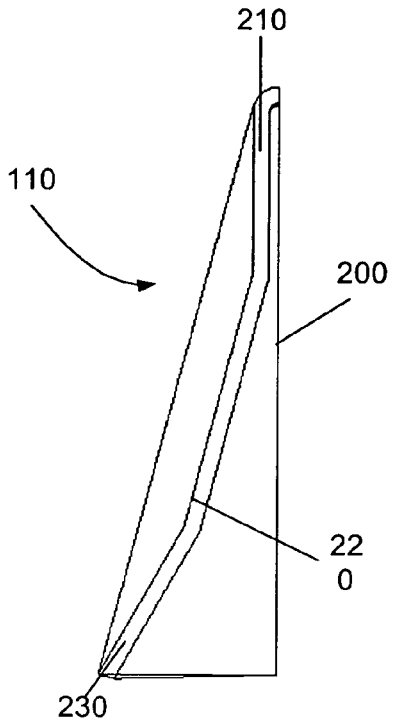
FIG. 2A illustrates a side view of an ink delivery regulation apparatus according to one exemplary embodiment.
Figure 2B:
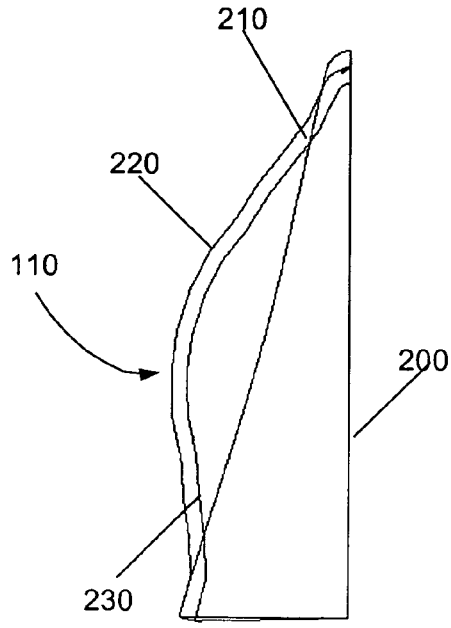
FIG. 2B illustrates a side view of an ink delivery regulation apparatus according to one exemplary embodiment.
Figure 2C:
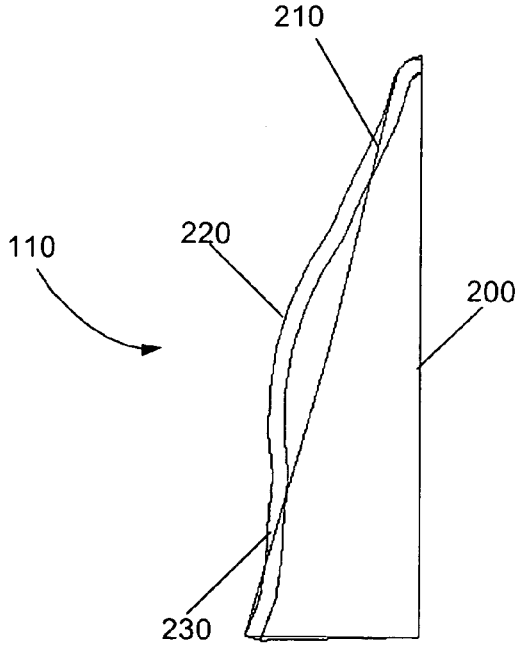
FIG. 2C illustrates a side view of an ink delivery regulation apparatus according to one exemplary embodiment.

FIGS. 2A–C illustrate an isolated side view of the ink delivery regulation member (110). In the illustrated assembly, the ink delivery regulation member (110) includes a support member (200), a first pressure tuned panel (210), a second pressure tuned panel (220), and a third pressure tuned panel (230). The first pressure tuned panel (210) is coupled to the support member (200) and to the second pressure tuned panel (220). The second pressure tuned panel is further coupled to the third pressure tuned panel (230) which is in turn coupled to the support member (200).

In FIG. 2A, the ink delivery regulation member (110) is shown in an undeflected condition. The first, second, and third pressure tuned panels (210, 220, and 230) are in a generally concave configuration with respect to the support member (200).

In FIG. 2B, the ink delivery regulation member (110) is shown in a fully deflected condition. The first, second, and third pressure tuned panels (210, 220, and 230) are in a generally convex configuration with respect to the support member (200).

In FIG. 2C, the ink delivery regulation member (110) is shown in an intermediately deflected condition. The first, second, and third pressure tuned panels are in an intermediate configuration, between the undeflected condition as shown in FIG. 2A, and the fully deflected position shown in FIG. 2B.

The deflection of the first, second, and third pressure tuned panels can be tuned to the specific requirements of particular print systems. For example, the overall size, the thickness, the elasticity, and the angles of the pressure tuned panels (210–230) may be varied so as to provide the proper deflection and thus the proper resistance in response to a force due to a negative pressure. Accordingly, the ink delivery regulation apparatus may allow for maintenance of the negative pressure within a determined range.

Exemplary Implementation and Operation

Figure 3:
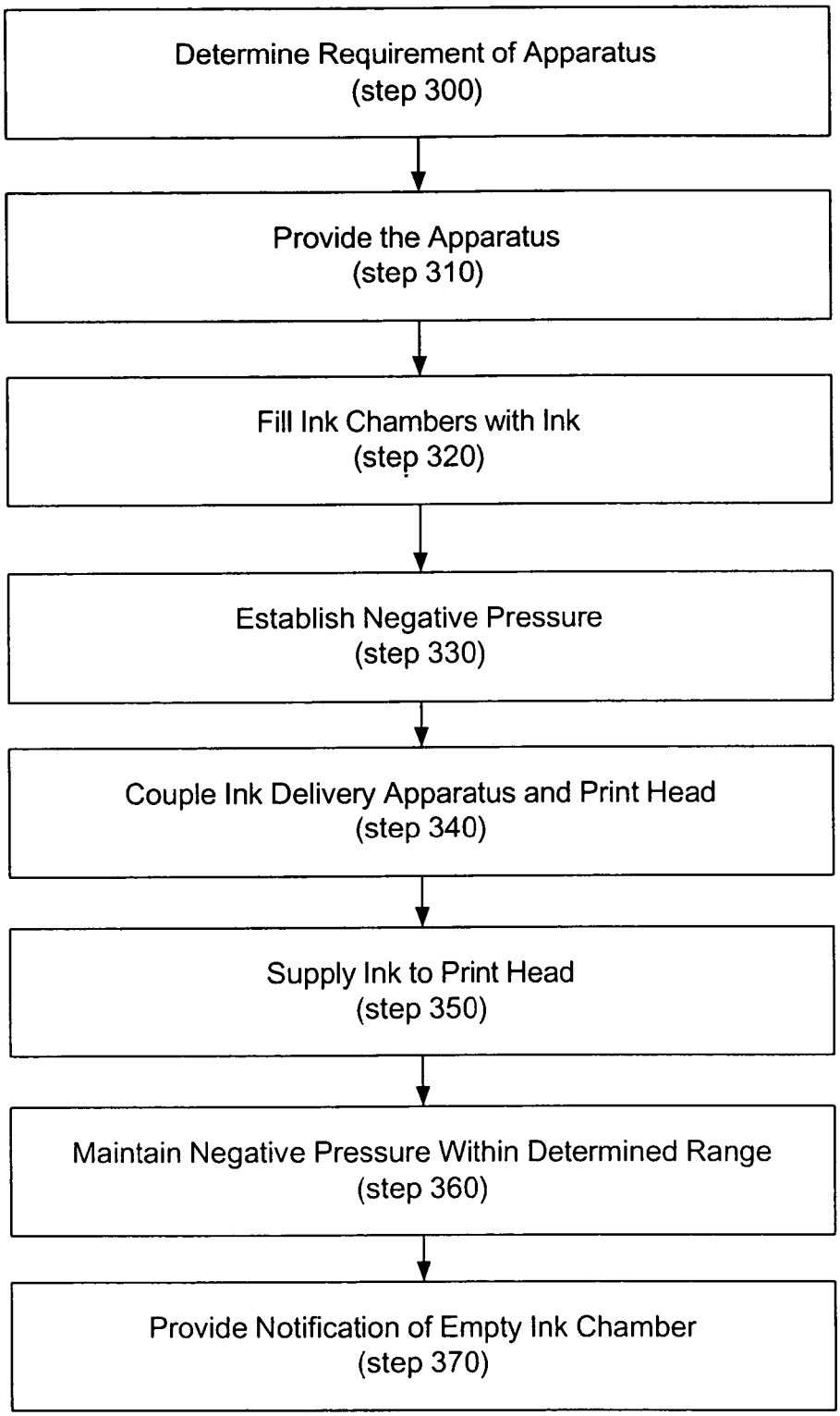
FIG. 3 is a flowchart of a method according to one exemplary embodiment.

FIG. 3 is a flowchart illustrating a process of using the ink delivery apparatus according to the present disclosure. The process begins by determining the requirements of the apparatus (step 300). These requirements may be based on the characteristics of a printing device with which the ink delivery apparatus is going to be used. These characteristics include the pressure and ink flow requirements of the printing device. Once the requirements of the apparatus have been determined (step 300), the ink delivery apparatus is provided according to those requirements (step 310). This includes formation of ink delivery regulation members in which the pressure tuned panels are formed of a selected material, with selected thicknesses, at selected angles relative to each other in order to meet the requirements determined above. The ink chambers are then filled with ink (step 320). The ink chambers may be filled through a second fluid interconnect that is sealed subsequent to filling. Once the ink chambers are filled with ink (step 320), a negative pressure is established within the ink chambers (step 330). This is accomplished by applying a positive pressure to the pressure responsive portion of the ink delivery regulation member while the ink chambers are filled (step 320) and then releasing the positive pressure once the ink chambers are filled with ink. The negative pressure may also be established by removing a small amount of ink from each of the ink chambers subsequent to filling the ink chambers (step 320). The ink delivery apparatus is then coupled to a print head (step 340). This may be done through a first fluid interconnect that includes a foam and a screen. Alternatively, the first fluid interconnect may include a septum. Once the ink delivery apparatus has been coupled to the print head (step 340), ink is supplied to the print head (step 350).

Supplying the ink (step 350) tends to cause the level of the negative pressure in the ink chamber to increase. It is desirable to maintain the pressure within a determined range (step 360). This maintenance of the negative pressure is accomplished through deflection of the pressure tuned panels, and results in a negative pressure range of between about 3–7" of water column. The pressure tuned panels deflect in response to a force due to the negative pressure. The amount of deflection of the pressure tuned panels is related, at least in part, to the thickness of the pressure tuned panels, as well as their elasticity and the relative angles of the pressure tuned panels with respect to each other and with respect to the support member. As the ink chamber is drained, the pressure tuned panels deflect from a generally concave configuration to a generally convex configuration, thereby resiliently resisting the force and maintaining the negative pressure within the determined range. In the event of a change in the ambient environment, the pressure tuned panels partially return to their undeflected conditions in response to the change in ambient conditions while maintaining the negative pressure within the determined limits.

In addition, a bubble generator may be used to maintain the negative pressure within the determined range. Bubble generators, or "bubblers", permit ambient air bubbles to enter the ink reservoir when the back pressure within the reservoir exceeds the pressure to which the bubbler is "tuned". The purpose of the air bubbles delivered by the bubble generator is to keep the reservoir back pressure from increasing to a level that would cause failure of the print head.

Bubble generators typically comprise a small-diameter orifice that provides fluid communication between the pen reservoir and ambient air. The bubble generator orifice is small enough, and the ink surface tension is great enough, to counteract the gravitational and static pressure forces that would otherwise cause ink to leak through the bubble generator orifice. Moreover, because the reservoir ink normally covers the reservoir-end of the bubble generator orifice, ambient air is restricted from entering the reservoir until the back pressure increases to a level great enough for drawing an air bubble through the reservoir ink covering the orifice. Other types of valves that perform an equivalent function are also known in the art.

As the pressure approaches its upper limit, the bubble generator may be activated to provide internal positive pressure. For example, the bubble generator may be tuned to 6" of water column. As a result, the negative pressure is maintained within the determined limits during the operational cycle of the ink chambers. Accordingly, the configuration of the ink delivery regulation member maintains the negative pressure within determined limits while compensating for variations in the ambient environment.

Figure 4:
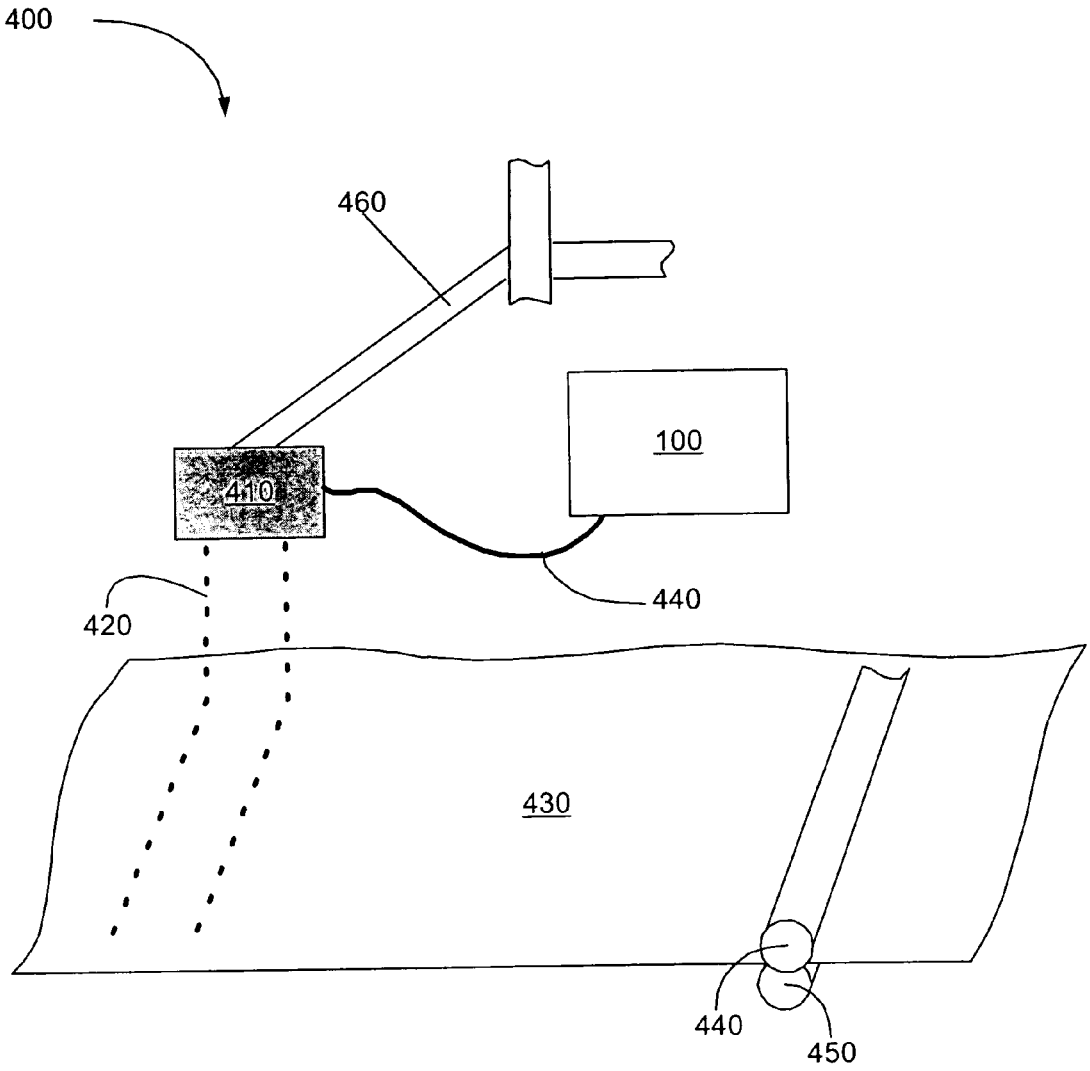
FIG. 4 illustrates a printing device according to one exemplary embodiment.

Once nearly all of the ink has been withdrawn from the ink chamber, the negative pressure increases sharply. This sharp increase in negative pressure indicates that the ink chamber is operationally empty. "Operationally empty" refers to the condition in which there is insufficient ink remaining in the piston to provide a reliable supply for printing. There may still be some ink in the piston. Thus, operationally empty does not mean completely empty. Accordingly, the pressure is monitored for a sharp increase in negative pressure. When such an increase is sensed, a user or the printer is notified that the ink chamber is operationally empty (step 370). As can be seen from the above process, the controlled deflection of the pressure tuned panels facilitates maintenance of a negative pressure within determined pressure limits as ink is withdrawn from the ink chamber. Such control allows for enhanced printer performance FIG. 4 illustrates a schematic representation of an off-axis printing device (400). When in operation, a print head (410) is coupled to the ink delivery apparatus (100). The print head (410) selectively ejects drops of ink (420) onto a print medium (430) according to print job data to form desired text and/or images on the print medium (430). The printing medium (430) is moved laterally with respect to the print head (410) by a print medium transport system, for example, two driven rollers (440, 450). The print head (410) is moved back and forth across the print medium (430) by, for example, a drive belt (460) or other device. The print head (410) contains a plurality of firing chambers that are energized on command by selectively firing resistors to selectively eject drops of ink. Consequently, as the print head moves laterally across the print medium (430) and the print medium (430) is moved by the rollers (440, 450), drops of ink (420) form text and/or images on the printing medium (430).

Maintenance of the negative pressure within the ink chamber (130) within determined limits facilitates improved performance of the printing device (400) by reliably supplying ink to the print head (410) while preventing the print head (410) from drooling ink onto the print medium (430) due to such occurrences as temperature or altitude variations. This is accomplished using the ink delivery regulation member (110) described above. Additionally, the ink delivery regulation member (110) allows for smaller printing devices due to the volumetric efficiency of the ink chamber (130, FIG. 1). A relatively low part count associated with some implementations of the ink delivery apparatus (100; FIG. 1) may also facilitate broader applications of printing devices. Further, use of an ink delivery regulation member allows for more complete evacuation of ink than with other systems. As a result, ink re-supply may occur less often, thereby increasing the uptime of the printing device (400) and decreasing the operating costs of the printing device (400).

The ink delivery regulation member (110) may be made of any material that allows it to be configured to at least partially collapse over a predetermined range of negative pressures. Such materials may include, but are in no way limited to, elastomeric materials such as EPDM/Butyl. In the illustrated examples, the pressure tuned panels may be of a constant thickness. This thickness may be, for example, between 0.4–0.8 mm. The ink delivery regulation member may be fabricated by any suitable means, such as, for example, molding.

Alternative Embodiments

Figure 5:
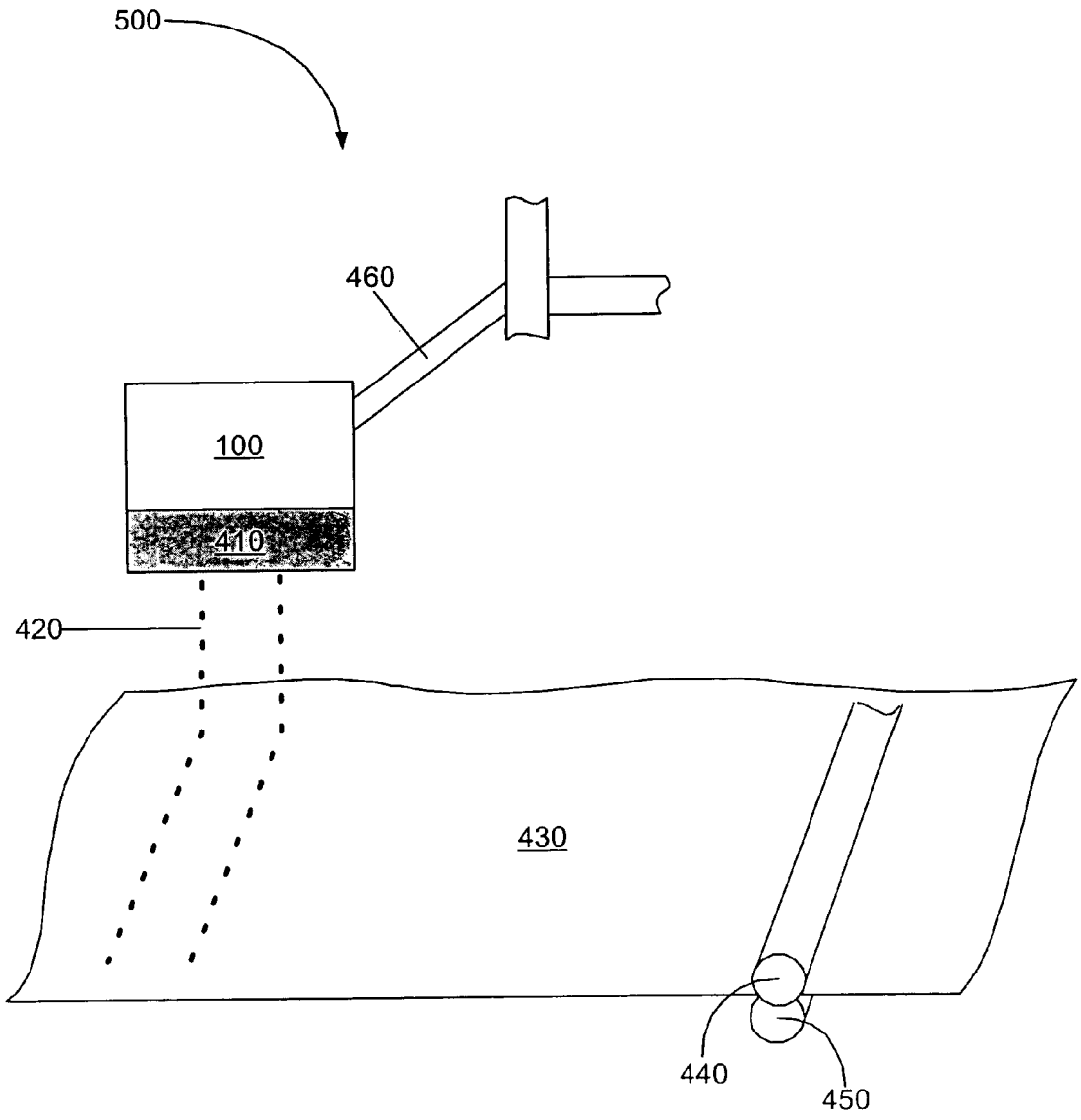
FIG. 5 illustrates a printing device according to one exemplary embodiment.

FIG. 5 illustrates an on-axis printing device (500). In an on-axis printing device, the ink supply travels with the print head. In such an embodiment, the ink delivery apparatus (100) described above is coupled to a print head (410). In the illustrated, on-axis configuration, the ink delivery apparatus (100) is directly coupled to a print head (410). In other on-axis printing embodiments, however, the ink delivery apparatus (100) may not be directly coupled to the print head (410). In all such systems, the volumetric efficiency of the pressure tuned ink chamber described above allows for smaller print cartridges. In addition, the volumetric efficiency of the pressure tuned ink chamber may decrease overall operating costs by requiring less frequent ink refills.

Referring again to FIG. 1, in other embodiments, an ink delivery apparatus (100) may be utilized to contain a plurality of ink colors, with each of the colors being separated one from another, for example, in separate chambers (130). Control of the negative pressure in the ink chambers (130) within determined limits facilitates improved performance of the printing device (e.g., 400; FIG. 4) by reliably supplying ink to the print head (410) while preventing the print head (410) from drooling ink onto the print medium (430). Further, providing a plurality of pressure tuned ink chambers allows for smaller color printing devices due to the volumetric efficiency of each pressure tuned ink chamber (130). Smaller print cartridges may allow for a decrease in the overall size of printing devices and facilitate broader applications of printing devices.

The preceding description has been presented only to illustrate and describe the present method and apparatus. It is not intended to be exhaustive or to limit the invention to any precise form disclosed. Many modifications and variations are possible in light of the above teaching. It is intended that the scope of the invention be defined by the following claims.

What is claimed is:

1. An ink delivery regulation apparatus, comprising:

an ink chamber configured to contain a quantity of ink;

a support configured to be coupled to said ink chamber; and a resilient deflection member coupled to said support, said resilient deflection member extending into said ink chamber and occupying a volume thereof, said resilient deflection member being configured to resiliently deflect between a generally concave shape and a generally convex shape in response to a change in a negative pressure in said ink exterior to said resilient deflection member, said resilient deflection member comprising a plurality of pressure tuned panels disposed at angles with respect to each other.

2. The apparatus of claim 1, wherein said support is configured to sealingly engage said ink chamber.

3. The apparatus of claim 1, wherein said resilient deflection member comprises first, second, and third pressure tuned panels.

4. The apparatus of claim 3, wherein said second panel is coupled to said support, said second panel being initially at a first angle relative to said first panel, at a second angle relative to said support, and at a third angle relative to said third panel.

5. The apparatus of claim 1, wherein said deflection member comprises an elastomeric material.

6. The apparatus of claim 5, where said elastomeric material comprises EPDM/Butyl.

7. The apparatus of claim 1, wherein said resilient deflection member is of substantially uniform thickness.

8. The apparatus of claim 1, wherein said deflection member is configured to change shape in response to a change in ambient conditions so as to maintain said negative pressure within predetermined limits.

9. An ink delivery apparatus, comprising:

an ink chamber; and a pressure regulation member having a support configured to be coupled to said ink chamber and a resilient deflection member extending from said support and into said ink chamber occupying a volume thereof, said resilient deflection member being configured to resiliently deflect between a generally concave shape and a generally convex shape in response to a change in a negative pressure in said ink chamber exterior to said resilient deflection member, said resilient deflection member comprising a plurality of pressure tuned panels disposed at angles with respect to each other.

10. The apparatus of claim 9, further comprising a fitment associated with said ink chamber.

11. The apparatus of claim 10, wherein said fitment is configured to couple with a print head.

12. The apparatus of claim 10, further comprising a bubble generator associated with said chamber.

13. The apparatus of claim 12, wherein said bubble generator is configured to limit said negative pressure within said chamber to a pressure equivalent to about 6" of water column during an operational period of said apparatus.

14. The apparatus of claim 13, wherein said bubble generator is disposed in said fitment.

15. An ink delivery apparatus, comprising:

a plurality of ink chambers; and a plurality of pressure regulation members, each a pressure regulation member being attached to a support that is configured to be coupled to said ink chambers, each pressure regulation member configured to be positioned within an ink chamber and comprising a resilient deflection member, said resilient deflection member being configured to resiliently deflect between a generally concave shape and a generally convex shape in response to a change in negative pressure.

16. The apparatus of claim 9, further comprising a plurality of ink chambers.

17. The apparatus of claim 16, further comprising a plurality of pressure regulation members associated with said chambers.

18. The apparatus of claim 16, wherein said plurality of ink chambers is configured to contain a plurality of differently colored inks.

19. An ink delivery apparatus, comprising:

a plurality of ink chambers; and an integral pressure regulation assembly having a plurality of pressure regulation members corresponding to said plurality of ink chambers, said assembly being configured to couple to said plurality of ink chambers;

wherein each pressure regulation member is configured to be positioned within one of said plurality of ink chambers and includes a resilient deflection member, said resilient deflection member being configured to resiliently deflect between a generally concave shape and a generally convex shape in response to a change in negative pressure, said resilient deflection member comprising a plurality of pressure tuned panels disposed at angles with respect to each other.

20. The apparatus of claim 19, wherein said plurality of ink chambers is configured to contain a plurality of differently colored inks.

21. The apparatus of claim 19, further comprising a fitment associated with said ink chamber.

22. The apparatus of claim 21, wherein said fitment is configured to couple with a print head.

23. The apparatus of claim 21, further comprising a bubble generator associated with said chamber.

24. The apparatus of claim 23, wherein said bubble generator is configured to limit said negative pressure within said chamber to a pressure equivalent to about 6" of water column during an operational period of said apparatus.

25. The apparatus of claim 24, wherein said bubble generator is disposed in said fitment.

26. A printing device, comprising:

an ink chamber configured to contain a quantity of ink; and a pressure regulation member having a support coupled to said ink chamber;

a resilient deflection member extending from said support into said ink chamber and occupying a volume thereof, said resilient deflection member being configured to resiliently deflect between a generally concave shape and a generally convex shape in response to a change in a negative pressure in said ink chamber exterior to said resilient deflection member, said resilient deflection member comprising a plurality of pressure tuned panels disposed at angles with respect to each other;

a fitment coupled to said ink chamber;

a bubble generator in communication with said ink chamber;

a print head coupled to said ink chamber.

27. The device of claim 26, wherein said pressure tuned panels comprise first, second, and third pressure tuned panels, wherein said second panel is coupled to said support, said second panel being initially at a first angle relative to said first panel, at a second angle relative to said support, and at a third angle relative to said third panel.

28. The device of claim 26, wherein said bubble generator is configured to provide a substantially constant pressure equivalent to about 6" of water column.

29. The device of claim 28, wherein said constant pressure is substantially equivalent to pressures of between about 3" and 7" inches of water column.

30. The device of claim 26, further comprising a plurality of ink chambers.

31. The device of claim 30, wherein said plurality of chambers comprises three chambers.

32. The device of claim 31, wherein said plurality of chambers are configured to contain a plurality of differently colored inks.

33. The device of claim 26, further comprising a fitment comprising first and second fluid interconnects, said first fluid interconnect being configured to fluidly couple said print head and said chamber, and said second fluid interconnect being configured to fluidly couple an ink supply and said chamber.

34. A method of delivering ink, comprising:

providing an ink chamber containing an ink and wherein is disposed a deflection member extending into said ink chamber and occupying a volume thereof, said resilient deflection member comprising a plurality of pressure tuned panels disposed at angles with respect to each other;

establishing a negative pressure in said chamber exterior to said deflection member;

supplying said ink to print head;

regulating a level of said negative pressure within a pre-determined range during said supplying of said ink by resiliently deflecting said deflection member in response changes in said negative pressure.

35. The method of claim 34, wherein said regulating step further comprises resilient deflecting said deflection member between a generally concave shape to a generally convex shape.

36. The method of claim 34, further comprising providing a plurality of said ink chambers and a corresponding plurality of said deflection members, wherein a deflection member is disposed in each of said chambers.

37. The method of claim 36, wherein each of said plurality of said chambers is configured to contain a differently colored ink.

38. The method of claim 34, further comprising using an internal pressure source.

39. The method of claim 38, wherein said internal pressure source comprises a bubble generator.

40. The method of claim 39, wherein said bubble generator is tuned to pressure equivalent to about 6" of water.

41. The method of claim 34, wherein said step of establishing said negative pressure comprises applying a positive pressure to said deflection member during a filling step, and removing said positive pressure at an end of said filling step.

42. The method of claim 34, wherein said step of establishing said negative pressure comprises removing a small amount of said ink.

43. The method of claim 34, further comprising moving said ink chamber with said print head.

* * * * *